United States Patent [19]

Miyoshi et al.

[11] 4,450,426

[45] May 22, 1984

[54] NONLINEAR RESISTOR AND PROCESS FOR PRODUCING THE SAME

[75] Inventors: Tadahiko Miyoshi; Takeo Yamazaki; Kunihiro Maeda; Ken Takahashi, all of Hitachi; Siniti Oowada, Katsuta, all of Japan

[73] Assignee: Hitachi, Ltd., Tokyo, Japan

[21] Appl. No.: 251,543

[22] Filed: Apr. 6, 1981

[30] Foreign Application Priority Data

Apr. 7, 1980 [JP] Japan ..... 55-44606

[51] Int. Cl.[3] ..... H01C 7/12

[52] U.S. Cl. ..... 338/21; 252/518; 361/127

[58] Field of Search ..... 338/21; 361/127; 29/610 R; 252/518

[56] References Cited

FOREIGN PATENT DOCUMENTS 50-27986 3/1975 Japan ..... 338/21

50-31959 10/1975 Japan ..... 338/21

52-66682 6/1977 Japan ..... 338/21

*Primary Examiner*—C. L. Albritton

*Attorney, Agent, or Firm*—Antonelli, Terry & Wands

[57] ABSTRACT

A nonlinear resistor comprising a sintered body containing zinc oxide as a major component and at least bismuth oxide and boron oxide and electrodes formed thereon, said sintered body having a higher γ-form bismuth oxide phase concentration in upper and/or lower surface layers of the sintered body than in the inner portion of the sintered body, has stabilized properties against long-time voltage application. When the sintered body is further modified by making the γ-form bismuth oxide phase concentration in the periphery portions of the upper and/or lower surface layers lower than that in the inner portions of the upper and/or lower surface layers, the resulting nonlinear resistor shows a higher long-duration current impulse withstand capability.

26 Claims, 16 Drawing Figures

NONLINEAR RESISTOR AND PROCESS FOR PRODUCING THE SAME

BACKGROUND OF THE INVENTION

This invention relates to a nonlinear resistor comprising a sintered body containing zinc oxide as its principal component in combination with additives such as bismuth oxide and boron oxide, and a method for producing such a resistor.

Nonlinear resistors comprising molded and sintered bodies of zinc oxide with additives such as bismuth oxide, manganese oxide, cobalt oxide, antimony oxide, chromium oxide, boron oxide and the like are widely used for voltage stabilizers, surge absorbers, arresters, etc. These nonlinear resistors are excellent in nonlinearity of voltage-current characteristics in comparison with the nonlinear resistors made of silicon carbide, but they involved problems in that their properties are subject to deterioration after surge absorption or long-time application of rated voltage, causing a gradual increase of leakage current and finally inducing thermal runaway. As to the property deterioration, it was known the following facts: (1) when a nonlinear resistor element is heated in a nitrogen gas atmosphere, there occurs the same pattern of property deterioration as that caused by voltage application, and (2) the element which suffered the property deterioration can recoup its original properties when the element is heat treated in air. Taking these facts into consideration, causes of the property deterioration seems to be that oxygen in the crystal grain bondary layers in the sintered body or oxygen adsorbed on the grain surfaces is released into the ambient atmosphere at the time of voltage application, resulting in a lowered potential barrier in the grain boundary layers to increase a leakage current.

The following methods have been proposed for minimizing such property deterioration of the zinc oxide based nonlinear resistors by improving stability to voltage application:

(1) Bismuth oxide is diffused from the entire surface of the sintered body (e.g., U.S. Pat. No. 3,723,175).

(2) The firing temperature for the sintered body or the temperature of the heat treatment after firing is controlled to elevate the ratio of $\gamma$-$Bi_2O_3$ phase in the $Bi_2O_3$ phase (e.g., U.S. Pat. Nos. 4,046,847, 4,042,535 and 4,165,351).

(3) Boron oxide or glass containing boron oxide is added (e.g., U.S. Pat. No. 3,663,458).

However, even the zinc oxide based nonlinear resistors incorporating said techniques were still unsatisfactory in that they could not maintain stabilized properties in all possible use conditions or that they were found defective in certain properties, particularly in long-duration current impulse withstand capability. The term "long-duration current impulse" used here refers to a surge with a pulse width of 2 msec and is supposed to simulate a switching surge.

SUMMARY OF THE INVENTION

An object of this invention is to provide a nonlinear resistor characterized by its stabilized properties against long-time voltage application, and a method for manufacturing such resistor.

Another object of this invention is to provide a nonlinear resistor having further improved long-duration current impulse withstand capability.

Thus, the present invention provides a nonlinear resistor comprising a sintered body containing zinc oxide as a major component and at least such additives as boron oxide and bismuth oxide and one or more electrodes provided to the upper and/or lower surfaces of said sintered body, characterized in that the $\gamma$-form bismuth oxide phase concentration in the electrode-forming surface layers of the sintered body is higher than that in the inner portion of the sintered body. The contents of boron oxide and bismuth oxide in the sintered body are preferably in the ranges of 0.01–5% by mole and 0.05–5% by mole, respectively.

This invention also provides a method for producing such a nonlinear resistor by using zinc oxide as its principal component, while adding at least boron oxide and bismuth oxide thereto, sintering these materials to form a sintered body and then forming one or more electrodes on the upper and/or lower surfaces of said sintered body, characterized in that a phase containing bismuth oxide with a higher concentration than the inner portion of a molded body is formed in the electrode-forming upper and/or lower surface layers of the body to be sintered, and then the molded body is subjected to sintering and a heat treatment to convert bismuth oxide in said surface layers into $\gamma$-form bismuth oxide. The heat treatment in this process is preferably carried out at a temperature between 500° and 800° C.

The present invention further provides a method for producing such a nonlinear resistor comprising a sintered body containing zinc oxide as a major component and at least boron oxide, and one or more electrodes formed at the upper and/or lower surfaces of said sintered body, wherein bismuth oxide is diffused from the electrode-forming upper and/or lower surfaces of the sintered body so as to make the $\gamma$-form bismuth oxide concentration in said surface layers higher than that in the inner portion of the sintered body. The temperature at which bismuth oxide is diffused in this method is preferably within the range from the melting point of bismuth oxide or higher and below the sintering temperature of said sintered body.

This invention still further provides a non-linear resistor comprising a sintered body containing zinc oxide as a major component and at least boron oxide as additives and one or more electrodes provided to the upper and/or lower surfaces of said sintered body, wherein the $\gamma$-form bismuth oxide phase concentration is higher in said electrode-forming surfaces than in the inner portion of the sintered body, and also said concentration in the peripheral portions or the side layer including said peripheral portions of the upper and/or lower surface layers is lower than the inner portions of the surface layers. This invention also provides a method for producing such a nonlinear resistor by forming such a $\gamma$-form bismuth oxide phase concentration distribution by diffusing bismuth oxide from the upper and/or lower surfaces, except for the peripheral portions, of the sintered body composed principally of zinc oxide. This invention further provides said type of nonlinear resistor in which the electrode ends reach said peripheral portions, and a method for producing the same.

BRIEF DESCRIPTION OF THE DRAWINGS

Referring here to the accompanying drawings, FIGS. 1, *2a–2c* and 3 are sectional views illustrating the structures of the nonlinear resistors in accordance with this invention.

DETAILED DESCRIPTION OF THE INVENTION

The invention is now described in detail referring to the accompanying drawings.

Figure 1:
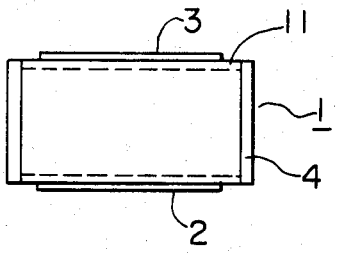
Figure 2A:
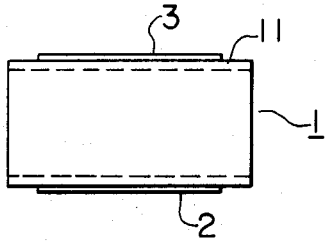
Figure 2B:
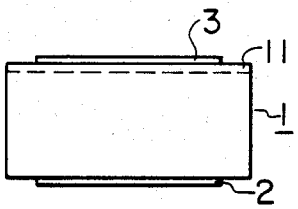
Figure 2C:
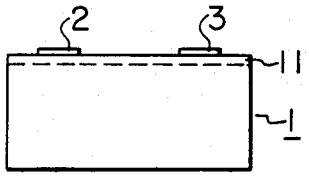

FIGS. 1 and 2 show schematic sectional views of the nonlinear resistors according to this invention. This invention is characterized by a remarkable improvement of stability against long-duration voltage application by increasing the ratio of γ-form bismuth oxide phase in the surface layers 11 of a zinc oxide sintered body 1 containing at least bismuth oxide and boron oxide, on which the electrode (2, 3) is formed. Although no clear account is yet given of the mechanism that brings about such improvement, the following reasons are suggested.

(1) The resistance of the nonlinear resistor (operating region) tends to be lowered when the content of γ-form bismuth oxide phase precipitated on the grain boundaries of ZnO increases more and more. According to the structure of this invention, the layers with low resistance are provided as the surface layers 11, so that the amount of heat evolved in the surface layers 11 upon application of a current is less than that in the inside of the resistor, which naturally lessens release of oxygen to the outside, resulting in a less chance of property deterioration of the surface layers 11. On the other hand, resistance is high and also much heat is evolved upon current application in the inside of the resistor where the content of the γ-form bismuth oxide phase is low, but since the release of oxygen to the outside is effected through the thick layers, such release is minimized to prevent property deterioration.

(2) The γ-form bismuth oxide phase has a body centered cubic form and its volume is larger than the α-form bismuth oxide phase (monoclinic) or β-form bismuth oxide phase (tetragonal), so that it has an effect of filling the spaces existing in the grain boundaries to inhibit migration of oxygen ions.

(3) It is believed that pentavalent bismuth is partly contained, in addition to trivalent bismuth, in the γ-form bismuth oxide phase, and this pentavalent bismuth functions to stabilize oxygen ions in the grain boundary layers to inhibit the release of such oxygen ions to the outside.

The nonlinear resistor according to this invention is also characterized by its stability against long-duration current impulse. This seems to be attributed to minimized vulnerability to breakdown by current concentration at the electrode ends owing to limited generation of heat in the surface layers 11.

In the present invention, a satisfactory effect is obtained when the content of the γ-form bismuth oxide phase in said surface layers 11 has a value of 1.05 or more as expressed in terms of the ratio of the γ-$Bi_2O_3$ concentration in the surface layer to that in the central portion, but the preferred value is 1.2 or more and usually a value between 1.2 and 10. The value of 10 cited is not to be taken as the upper limit; a greater value may be employed, but a value of up to about 10 proves to be quite satisfactory in the usual modes of use. As for the thickness of the surface layers 11, it is 1/100 to 1/6, preferably 1/40 to 1/10, of the thickness of the sintered body, and more concretely, it is about 0.5 to 2 mm in the ordinary nonlinear resistors having a thickness of 20 mm. This can provide devices with life expectancy of 100 to 150 years at an ambient temperature of 40° C. and under voltage application corresponding to initial current of 1 mA. In the present invention, the whole of bismuth oxide may be γ-form bismuth oxide.

A better result is obtained when boron oxide is contained in the sintered body. The γ-form bismuth oxide phase is usually a meta-stable phase, but there occurs a phase change of bismuth oxide into γ-form by a heat treatment at a certain temperature range. Boron oxide has the effect of stabilizing the γ-form bismuth oxide phase. Particularly, it acts to prevent change of the γ-form phase into another phase due to a heat cycle involving long-time voltage application or surging. Thus, boron oxide is indispensable for realizing long-time stabilization.

Figure 3:
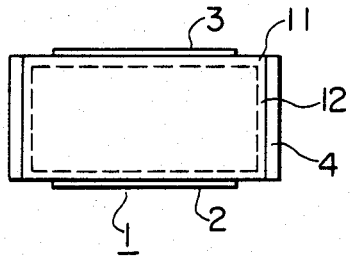

In the present invention, the content of the γ-form bismuth oxide phase in the side face layer 12 at the side not provided with an electrode of the resistor can be made larger than that in the central portion, as shown in FIG. 3. In this case, too, the nonlinear resistor is provided with high stability to long-time voltage application. In this case, however, because of low resistance in the side face layers 12, a current concentration tends to occur to cause short-circuiting along the side surfaces at the time of impulse loading such as lightning surge or switching surge, so that this type is unsuited for applications involving use of an ultra-high voltage.

In the present invention, the following method may be employed for forming a structure where the content of γ-form bismuth oxide in the surface layer is greater than that in the inside, that is, a base body is first prepared in which the bismuth oxide content in the surface layer is higher than that in the inside, and then such body is molded and fired, followed by a heat treatment under a specific temperature condition. Alternatively, a diffusing agent containing bismuth oxide is deposited or coated on the surface and then subjected to a heat treatment to effect diffusion of bismuth oxide while simultaneously causing a phase change into the γ phase.

The above-said methods, particularly the last-mentioned diffusion method seems to be effective for preventing oxygen ions from releasing out of the sintered body because the diffused bismuth oxide phase fills up voids existing in the sintered body or spaces in the ZnO grain boundaries in the course of diffusion through such voids or spaces. It is also an advantage of this method that the bismuth oxide concentration distribution can be continuously changed from the surface toward the center of the inside portion, allowing continuous mitigation of thermal stress built up in the inside of the sintered body by the current flow caused on a specific occasion such as at the time of switching surge. Diffusion may be effected in any suitable known way. For instance, a diffusion layer may be formed by applying bismuth oxide with water or an organic solvent or by using an evaporation technique. For effecting such diffusion, use of additives such as boron oxide, silicon oxide, cobalt oxide, etc., is not essential.

However, in case the amount of boron oxide originally existing in the sintered body is scarce, it is possible to supplement boron oxide by diffusing a mixture of bismuth oxide and boron oxide. But in this case, it is essential that boron oxide is contained in the sintered body from the beginning since boron oxide is less apt to diffuse than bismuth oxide and won't readily diffuse into the inside of the sintered body.

The nonlinear resistor according to this invention is preferably of a composition comprising zinc oxide as its principal component and 0.05 to 5% by mole of bismuth oxide and 0.01 to 5% by mole of boron oxide. If the amount of bismuth oxide is outside the said range or if the amount of boron oxide is in excess of 5% by mole, there may occur a drop of the non-linearity coefficient in the low current range (e.g., $3\times10^{-6}$ to $3\times10^{-4}$ A/cm$^2$). This leads to an increased leakage current at the time of voltage application to reduce the life at the continuous AC operating stress. Also, if the amount of boron oxide is less than 0.01% by mole, there is provided no satisfactory $\gamma$-form bismuth oxide phase stabilizing effect, and this, again, may cause a reduction of the operable life.

In the surface layers rich with the $\gamma$-form bismuth oxide phase, the following boron oxide to bismuth oxide ratio is preferred:

(Boron oxide)/(bismuth oxide)$\leqq$0.3 (molar ratio)

This can eliminate the fear of local fusion of the surface layers during said long-duration current impulse treatment to improve the long-duration current impulse withstand capability. It can also enhance stabilization against long-time voltage application under a high humidity condition. This is considered due to the higher melting point (about 820° C.) of bismuth oxide than the melting point (about 460° C.) of boron oxide and also higher moisture resistance of the former than the latter.

It is further desirable that the molar ratio of said both compounds in the inside of the sintered body is 1 or less. If said molar ratio is larger than 1, there may occur a drop of the non-linearity coefficient in the low current region.

The nonlinear resistor according to this invention may contain, in addition to said additives, one or more of the following compounds: manganese oxide, antimony oxide, cobalt oxide, chromium oxide, nickel oxide, silicon oxide (each in an amount of about 0.05 to 5% by mole) and aluminum oxide and gallium oxide (each in an amount of about 0.001 to 0.05% by mole). These additives are helpful for improving the non-linearity coefficient as well as the life at the continuous AC operating stress or high current impulse withstand capability of the elements.

According to the study by the present inventors, the temperature range in which the bismuth oxide phase changes into the $\gamma$-phase is variable depending on the amount of impurities (such as ZnO, $B_2O_3$, etc.) contained in the bismuth oxide phase. Similarly, in the case of diffusion, the phase-changing temperature range differs between the bismuth oxide phase initially contained in the sintered body and the diffused bismuth oxide phase and their reaction layer (mutual diffusion layer). It is to be noted that in the case of a mixture system in which the diffused bismuth oxide phase and the reaction layer change into the $\gamma$-form while the bismuth oxide phase initially contained in the sintered body (such phase being considered a mixture of $\alpha$-phase, $\beta$-phase, etc.) does not change into the $\gamma$-form, the resulting nonlinear resistor is not only prolonged in the life at the continuous AC operating stress but also shows a large non-linearity coefficient in the low current range (e.g., $3\times10^{-6}$ to $3\times10^{-4}$ A/cm$^2$). The reason for this is yet unknown, but it is observed that the bismuth oxide phase originally existing in the sintered body encompasses the ZnO grains to become a decisive factor for the non-linearity coefficient, and the coefficient becomes large when said phase is not the $\gamma$-phase. On the other hand, it is considered that the diffused bismuth oxide phase ($\gamma$-form) and the reaction layer stay around the bismuth oxide phase originally existing in the sintered body to play a key role for stabilizing the element. More concretely, in the composition range in this invention, the bismuth oxide phase originally existing in the sintered body changes into the $\gamma$-form upon heating at 500°-800° C. while the diffused bismuth oxide changes into the $\gamma$-form upon heating at 800°-1100° C. Therefore, if the diffusion temperature is controlled at about 800°-1100° C., it is possible to convert only the diffused bismuth oxide phase and the reaction layer into the $\gamma$-form. Also, by increasing the amount of bismuth oxide diffused, it is possible, even at the same diffusion temperature, to let the diffused bismuth oxide react with the whole of bismuth oxide originally existing in the sintered body to convert all of bismuth oxide staying in the sintered body into the $\gamma$-form. In this case, the obtained nonlinear resistor is particularly prolonged in the life at the continuous AC operating stress.

Thus, the heat treatment temperature for diffusion should be above the temperature at which bismuth oxide is diffused into the sintered body but should be lower than the sintering temperature of the sintered body. It is also recommended to perform such heat treatment at a temperature above the melting point (about 820° C.) of bismuth oxide because otherwise the diffusion rate proves to be excessively low. Use of a temperature higher than the sintering temperature can produce no effect of diffusion.

For retaining the originally contained bismuth oxide phase as the $\alpha$- or $\beta$-form while converting only the diffused bismuth oxide phase and the reaction layer into the $\gamma$-form, it is preferable to make the molar ratio of the initially contained boron oxide to bismuth oxide 0.03 or more while using a diffusion temperature within the range from the melting point of bismuth oxide to 1100° C.

Use of the conditions outside the above-defined range may fail to effect desired change into the $\gamma$-form, or even if the phase change into the $\gamma$-form can be made, a further phase change into the $\alpha$- or $\beta$-form may unfavorably take place successively.

It is particularly desirable that the $\gamma$-form bismuth oxide phase is contained even in the deep inside of the sintered body as it can prevent the migration of oxygen ions in the central portion to enhance the stability against long-time voltage application.

In order to provide the nonlinear resistor of this invention with even more stabilized properties in long-time voltage applications and a higher long-duration current impulse withstand capability, it is advised to form a structure in which the $\gamma$-form bismuth oxide phase concentration at the peripheral portion of the electrode-forming surface is lower than that in the inside portion of said surface. Such a structure is further described below with reference to FIGS. 7 and 8 of the accompanying drawings. The γ-form bismuth oxide phase concentration in the surface layers 11 is higher than that of the inner portion of the bismuth oxide-containing zinc oxide sintered body 1 and in the surface layers 11 the central portions to be provided with electrodes 2 have the highest γ-form bismuth oxide phase concentration. As said before, this γ-form bismuth oxide phase having the special concentration distribution has the effect of improving stability of the nonlinear resistor against long-time voltage application.

The surface layer having a high content of said γ-form bismuth oxide phase can be formed by coating or depositing a diffusing agent containing bismuth oxide on each electrode-forming surface of the sintered body except for the periphery portions on the surface and subjecting the diffusing agent to a heat treatment to effect diffusion of bismuth oxide while simultaneously inducing the phase change into the γ-phase. In the course of this treatment, as the diffused bismuth oxide phase is diffused through the voids existing in the sintered body or in the zinc oxide grain boundaries, such voids are filled up to prevent the release of oxygen into the outer atmosphere from the sintered body. This diffusion method may be of any generally known type. For instance, bismuth oxide may be coated by using water or an organic solvent, or vacuum evaporated to form a diffusion layer.

The described structure and its producing method according to this invention can improve not only stability of the obtained nonlinear resistors against voltage application but also long-duration current impulse withstand capability.

Figure 7:
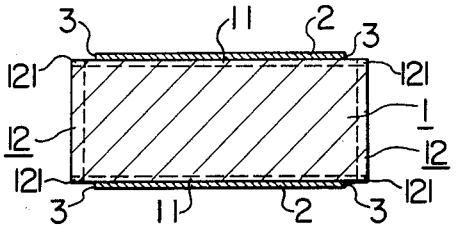
FIGS. 7 and 8 are sectional views showing the structures of the further improved nonlinear resistors according to this invention.

In the structure of FIG. 7, a breakdown is most likely to occur at each end 3 of each electrode 2 when a long-duration impulse current, for example a 2 msec rectangular impulse current flows through the sintered body 1. This seems to be due to the following reason: there occurs an electric field concentration at each electrode end portion and hence this portion is exposed to an electric field approximately 4 to 5 times stronger than that applied to the other portions, so that a greater current flows to said each electrode end portion of the sintered body than to the other portions to make said each end portion more vulnerable to thermal breakdown.

Here, if the bismuth oxide phase is allowed to diffuse from the entire electrode-forming surfaces of the sintered body, it is highly probable that the bismuth oxide phase fused in the course of diffusion would flow from the electrode-forming surfaces to the side faces and deposit on the side faces. If diffusion further advances, the γ-form bismuth oxide phase concentration in the side face layer becomes higher than the inside portion of the sintered body to reduce resistance of the side face layer. This further encourages current concentration at the electrode end portions near the side face layer, resulting in an excessive reduction of the long-duration current impulse withstand capability. Further, because of reduced resistance in the side faces, there tends to occur short-circuiting along the side face at the time of application of a short-duration impulse current, and the withstand capability is also lowered. Moreover, it is very difficult to perfectly control diffusion so as not to make the bismuth oxide phase flow to the side face, and the manufactured elements, even if manufactured with much care, are subject to wide dispersion in withstand capability against long-duration impulse currents.

According to the structure and its producing method of this invention, there is no possibility that the bismuth oxide phase flows to the side face in the course of diffusion. Further, the content of the γ-form bismuth oxide phase is lessened at the peripheral portions 121 of the electrode-forming surfaces of the sintered body or at the side face layers 12 including such peripheral portions, and the resistance in these regions can be made higher than that in the inside. The thickness of the side face layer is about 1/200 to 1/10, preferably 1/120 to 1/30 of the width (or a diameter) of the sintered body and concretely about 0.5 to 2 mm when the sintered body has a diameter of 60 mm. Accordingly, any trend of current concentration at the electrode end portions in the vicinity of said regions is reduced to improve the withstand capability against long-duration impulse current.

Figure 8:
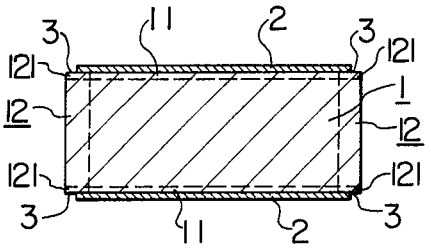

Particularly, in the structure of FIG. 8 where the ends 3 of the electrodes 2 reach the peripheral portions 121 which are left unchanged at the time of the bismuth oxide phase diffusion, the sintered body portions adjoining the electrode ends have higher resistance than the portions contacting most of other portions of the electrodes, which results in being greatly effective for enhancing the long-duration current impulse withstand capability while reducing the current concentration at the electrode ends.

The peripheral portions which are excluded from bismuth oxide phase diffusion in this invention occupy only a small part of the area of the electrode-forming surfaces of the sintered body, so that there can be obtained the same effect of improving stability against voltage application as in case the bismuth oxide phase is diffused from the entire electrode-forming surfaces.

The nonlinear resistor according to this invention may contain, in addition to zinc oxide, bismuth oxide and boron oxide, one or more of the following compounds: manganese oxide, cobalt oxide, chromium oxide, antimony oxide, nickel oxide, silicon oxide (each in an amount of 0.01 to 10% by mole), aluminum oxide, gallium oxide (each in an amount of 0.001 to 0.01% by mole), etc. These additives are effective for enhancing the non-linearity coefficient of the element or improving the life at the continuous AC operating stress or high current impulse withstand capability.

Bismuth oxide is diffused in the sintered body, but preferably a raw material of zinc oxide already containing bismuth oxide in an amount of 0.05% by mole or more is molded and fired. If the amount of bismuth oxide is too little, e.g. less than 0.05% by mole, the sintered body shows poor sinterability, resulting in an unsatisfactory non-linearity. The amount of bismuth oxide to be diffused may be suitably choiced to meet the requirement to fill up most of the voids in the sintered body. It is usually desirable that such amount is 0.01% by mole or more.

It is preferable to contain boron oxide in the sintered body. The γ-form bismuth oxide phase is usually a metastabilized phase, and boron oxide is effective for stabilizing the γ-form bismuth oxide phase formed as a result of the phase change by the heat treatment. Particularly, presence of 0.01 to 0.5% by mole of boron oxide is essential for preventing the phase change from the γ phase into other phase in a heat cycle involving long-time application of voltage or surges to realize long-time phase stabilization.

It is to be noted in connection with the diffusing operation that if the diffusion temperature is below the melting point (about 820° C.) of bismuth oxide, the diffusion rate becomes too slow, while if the diffusion temperature exceeds the sintering temperature of the sintered body, there can be derived no desired effect of diffusion. Therefore, the temperature used for the heat treatment by diffusion is preferably within the range from the melting point of bismuth oxide to the sintering temperature.

In order to form the γ-form bismuth oxide phase with good reproducibility, it is recommended to use a heat treatment temperature below 1100° C.

A glass film, insulating ceramic film or such may be provided on the side surfaces of the sintered body for the purpose of enhancing the short-duration impulse current withstand capability.

The nonlinear resistor according to this invention can be used for voltage stabilizers, surge absorbers, arresters and the like.

Figure 12:
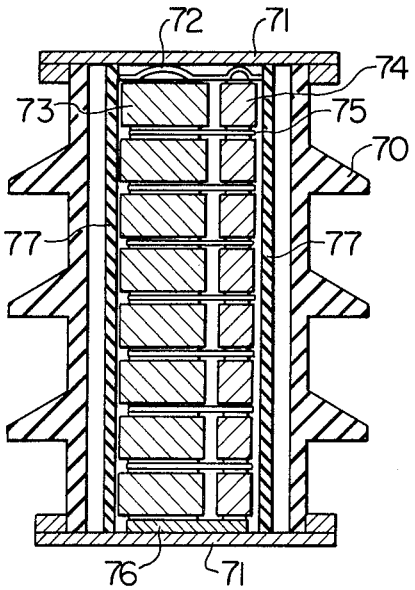
FIGS. 12 to 14 are sectional views of the arrestors applying the nonlinear resistors according to this invention.
Figure 13:
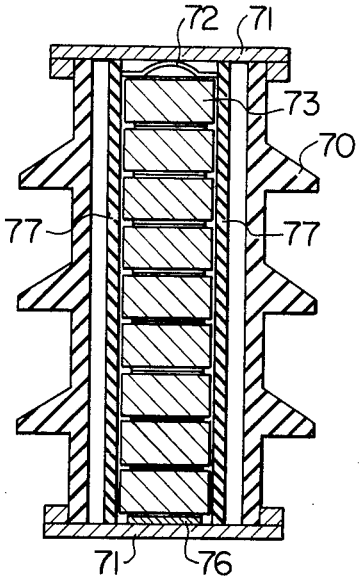
Figure 14:
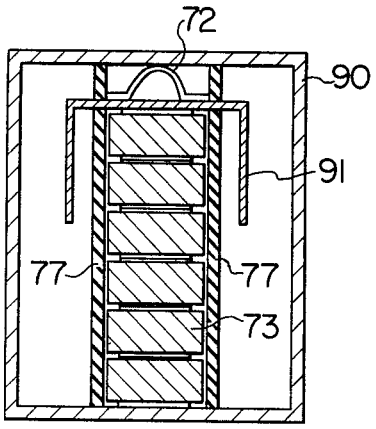

FIGS. 12 to 14 exemplify application of the nonlinear resistor of this invention to arresters. In these drawings, numeral 70 designates an insulator, 71 top and bottom covers, 72 a leaf spring designed to serve as top terminal, 73 a nonlinear resistor element, 74 a field correcting capacitor, 75 a lead wire, 76 a bottom terminal, and 77 an insulating bar for fixing the element in position. As a housing means, a metal tank 90 such as shown in FIG. 14 may be used instead of the insulator 70. Also, a metal shield 91 may be used in place of the capacitor 74 as field correcting means. One or a plurality of non-linear resistor elements of this invention may be stacked in the housing means.

This construction provides an arrester with a long service life and high reliability because of the long life (under continuous AC operating stress) of the nonlinear resistor used therein. Generally, there exists a problem in that, due to the floating capacity between the nonlinear resistor element and the ground, a strong electric field is applied to the elements in the upper portion to shorten the life of such elements. In order to avoid such a problem, it is usually practiced to provide one or more capacitors such as shown in FIG. 12 or a metallic shield such as shown in FIG. 14 to thereby correct the electric field exerted. In the arrester of this invention, however, since the nonlinear resistor element adopted therein has a long life even if used in a high electric field, it is possible to omit the field corrector element from the mechanism in the container as shown in FIG. 13. This reduces the number of the arrester parts, which results in facilitating the manufacture of the arrester and improving its reliability as a whole. Also, since the container can be reduced in size, it is possible to attain a reduction of size and weight of the arrester and to improve its earthquake resistance.

This invention is further explained in detail by way of the following Examples, in which all percents are by weight unless otherwise specified.

EXAMPLE 1

To ZnO, 0.7% by mole of $Bi_2O_3$, 0.5% by mole of $MnCO_3$, 1.0% by mole of $Co_2O_3$, 0.5% by mole of $Cr_2O_3$, 1.0% by mole of $Sb_2O_3$, 1.0% by mole of NiO, 1.5% by mole of $SiO_2$, 0.1% by mole of $B_2O_3$ and 0.005% by mole of $Al(NO_3)_3$ were added (a total being 100% by mole) and mixed in a ball mill for 10 hours. To this pulverized mixture of raw materials was added 10% of a 2% polyvinyl alcohol solution and the mixture was granulated. Then the mixture was molded into a disc such as shown in FIG. 2*a* and fired in air at 1,350° C. for one hour. The principal surfaces of the obtained sintered body were polished to reduce a thickness of 0.5 mm from principal surface to obtain an element of 60 mm in diameter and 20 mm in thickness. Then both principal surfaces of this element were coated substantially uniformly with a paste containing 2 g of bismuth oxide, 0.05 g of ethyl cellulose and 0.4 g of butyl carbitol and heat treated at 950° C. for 2 hours. Lastly Al was flame sprayed to said both principal surfaces to form electrodes (56 mm in diameter).

The obtained element showed a non-linearity coefficient of 50 (at current application of $3\times10^{-6}$ to $3\times10^{-4}$ A/cm$^2$), a flatness (ratio of the voltage at a current of $3\times10^{+3}$ A/cm$^2$ to the voltage at $3\times10^{-4}$ A/cm$^2$) of 1.55 and a rectangular current impulse withstand capability (pulse width: 2 msec) of over 3,500 A.

Figure 4:
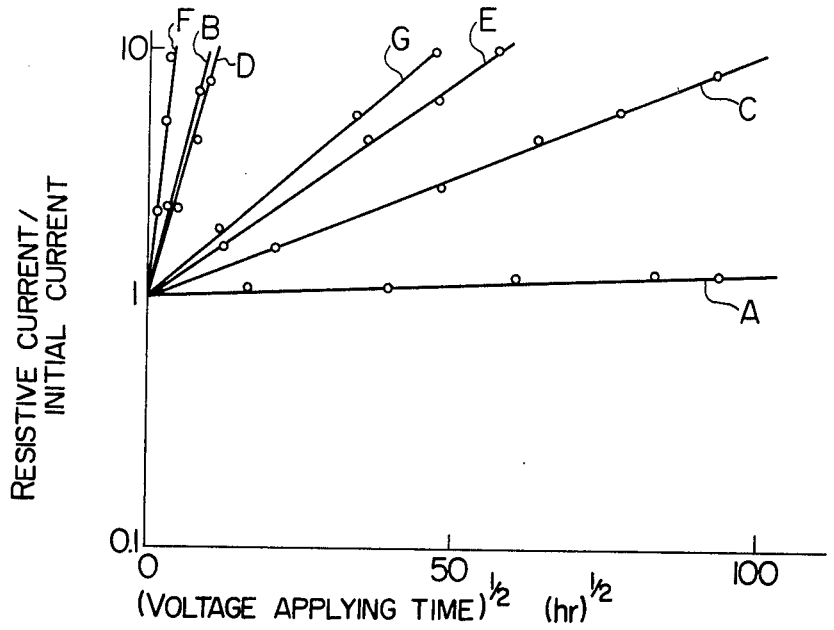
FIGS. 4 to 6 are graphs of characteristic curves showing property comparisons between the nonlinear resistors according to this invention and the conventional ones.

FIG. 4 is a graph showing the change with time of the resistive current when an AC current was applied continuously to the nonlinear resistor of this invention at a temperature of 90° C. and at an applied voltage ratio (a ratio of peak value at AC voltage/voltage at DC required for flowing 1 mA at 20° C.) of 100%. In the graph of FIG. 4, A represents the element obtained in the instant Example, B represent an element obtained in the same way as this Example but not yet subjected to bismuth oxide diffusion, C represents an element which, after sintering, was subjected to a 2-hour heat treatment at 750° C. instead of the bismuth oxide diffusion, D represents a similar element subjected to a 2-hour heat treatment at 950° C., E represents an element obtained in the same way as the instant Example but not containing boron oxide as additive, F represents an element obtained in the same manner as the element E but not yet subjected to the bismuth oxide diffusion, and G represents an element obtained in the same manner as the element E but subjected to the diffusion of glass comprising 65% $Bi_2O_3$, 15% $B_2O_3$, 10% $SiO_2$, 5% $Ag_2O$ and 5% CoO (all percentages being by weight) instead of the diffusion of bismuth oxide.

As shown in FIG. 4, the element of this invention is small in change of resistive current (given by subtracting the capacitive current from the total current at the time of AC application) and is far longer than the other elements in the life at the continuous AC operating stress. When possible acceleration of the property degrading rate by temperature is taken into account, it is observed that the total current applying time of 10,000 hours at 90° C. is equivalent to more than 100 years at 40° C. in practical uses. This indicates excellent serviceability of the nonlinear resistor of this invention as an arrester for a UHV transmission system (over 1,000 kV).

Figure 5:
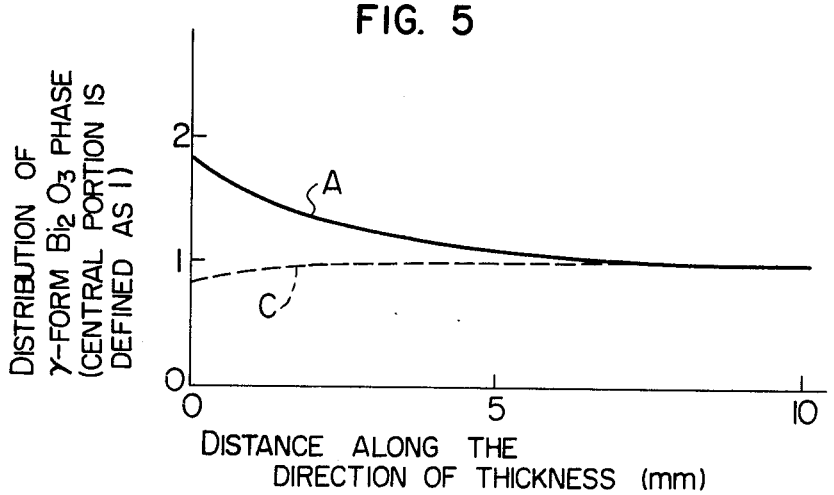
Figure 6:
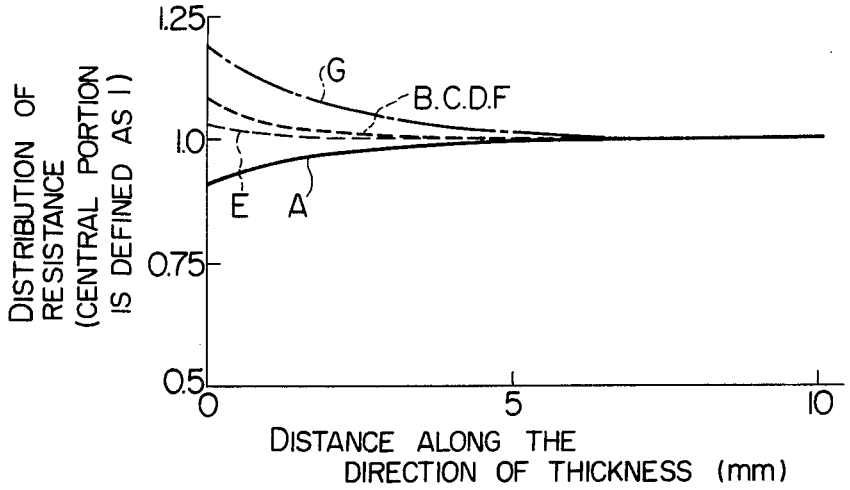

FIGS. 5 and 6 show the distribution of γ-form $Bi_2O_3$ phase and the distribution of resistance, respectively, in the obtained nonlinear resistors. The γ-form $Bi_2O_3$ phase distribution was determined from intensities of the diffracted lines with spacing of 2.71–2.72 Å of the γ-$Bi_2O_3$ phase (standardized by the diffracted line intensity of ZnO) according to the X-ray powder diffraction method by cutting specimens to a thickness of 0.5 mm parallel to the electrode surface and pulverizing the cut pieces. The resistance distribution was determined from the voltage distribution by contacting a probe of 1 mm in diameter to the corresponding portions on both sides of the specimen (before electrode formation) and measuring the voltage distribution at the time of current application of 2 μA (current density: $3\times10^{-4}$ A/cm$^2$) while shifting the probe along the direction of thickness.

As shown in FIGS. 5 and 6, in the nonlinear resistor (A) according to this invention, the amount of the γ-form $Bi_2O_3$ becomes larger, the smaller the distance from the electrode-formed surface and at the same time the resistance becomes lower accordingly. Since specimen D contains no γ-form $Bi_2O_3$, it will be seen that γ-form $Bi_2O_3$ in specimen A derives only from diffused $Bi_2O_3$ and that portion of $Bi_2O_3$ originally existing in the sintered body which has reacted with diffused $Bi_2O_3$. Specimens B and D-G contain no γ-form $Bi_2O_3$. Specimen C contains γ-form $Bi_2O_3$, but the content of the γ-form $Bi_2O_3$ in the vicinity of the electrode surface is small. This is considered due to evaporation of $Bi_2O_3$ during the firing. Bismuth oxide in specimen C was entirely changed into the γ-form phase, resulting in poor non-linearity of the V-I characteristics and having a non-linearity coefficient of 7 and a flatness of 2.

As shown in FIG. 6, specimens B-G show a resistance distribution where the resistance increases along the way to the electrode surface. Such distribution pattern is considered attributable, in the case of specimens B-F, to the density distribution of the sintered body and evaporation of $Bi_2O_3$ during sintering and, in the case of specimen G, to diffusion of glass components other than $Bi_2O_3$.

An element which has been subjected to diffusion of bismuth oxide from the entire surfaces according to the manner of the instant Example showed a long life at the continuous AC operating stress as specimen A of FIG. 4 but its rectangular-current impulse withstand capability was about 1600 A, which is about half that of the element of the instant Example.

EXAMPLE 2

A sintered body was prepared in the same manner as described in Example 1. The principal surfaces on both sides, after polishing, were coated substantially uniformly with a paste comprising 8 g of bismuth oxide, 0.2 g of ethyl cellulose and 1.2 g of butyl carbitol and then heat treated at 1,000° C. for 4 hours, followed by formation of the electrodes after the fashion of Example 1.

The change of resistive leakage current in the obtained element, as measured by continuously applying an AC current at a temperature of 90° C. and an applied voltage ratio of 100%, was ½ of that of A of FIG. 4. X-ray powder diffraction revealed that the $Bi_2O_3$ in the specimen was all γ-form and the γ-$Bi_2O_3$ concentration in the electrode-forming surface layers (2 mm thick) was approximately twice that in the center portion of the sintered body.

EXAMPLE 3

The same raw materials as used in Example 1 except for changing the amounts of $Bi_2O_3$ and $B_2O_3$ as shown in Table 1 were mixed, granulated, molded and calcined at 900° C. for 2 hours. To the sides of the specimen was applied a paste prepared by mixing ethyl cellulose and butyl carbitol in a powdery mixture of 8% by mole $Bi_2O_3$, 20% by mole $Sb_2O_3$ and 72% by mole $SiO_2$, followed by firing at 1,150° C. for 5 hours. The paste applied to the specimen sides reacted with the ZnO element during sintering to form a high-resistance layer 4 as shown in FIG. 1. The principal surfaces of the sintered body were polished to remove a thickness of 0.5 mm, then coated with pastes containing bismuth oxide in various amounts and then heat treated at a temperature within the range of 820°-1,100° C. for 2 hours. Lastly, electrodes were provided to both principal surfaces to obtain an element having the construction of FIG. 1.

The producing conditions (mixing ratios of the raw materials and ratio of the amount of $Bi_2O_3$ diffused to the amount of $Bi_2O_3$ contained in the entire sintered body), $B_2O_3/Bi_2O_3$ molar ratio in the surface layers, distribution of γ-form $Bi_2O_3$ and non-linearity coefficient of the obtained specimen are shown in Table 1. The time required till reaching the twice as much resistive current as the initial value and the rectangular-current impulse withstand capability, as determined in a voltage applying test under the same conditions as in Example 1 (except for the ambient temperature of 110° C.), are also shown in Table 1. The $B_2O_3/Bi_2O_3$ molar ratio was determined by chemical analyses (colorimetry for $B_2O_3$ and atomic spectroscopy for $Bi_2O_3$) by shaving off the surface layer.

TABLE 1

| Run No. | Mixing ratio (% by mole) $B_2O_3$ | $Bi_2O_3$ | $B_2O_3/Bi_2O_3$ (% by mole) | Diffused $Bi_2O_3$ / Total $Bi_2O_3$ | $B_2O_3/Bi_2O_3$ in surface layer (% by mole) | γ-$Bi_2O_3$ in surface layer / γ-$Bi_2O_3$ in center portion | α* | Life at the continuous AC operating stress (hr) | Rectangular current withstand capability (A) |
|---|---|---|---|---|---|---|---|---|---|
| 1 | 0 | 0.02 | — | 0.2 | — | —** | 5 | 0.5 | 4000 |
| 2 | 0 | 0.05 | — | " | — | —** | 42 | 5 | 3500 |
| 3 | 0.01 | " | 0.2 | 0.02 | 0.19 | 1.05 | 43 | 500 | 3600 |
| 4 | " | " | " | 0.06 | 0.17 | 1.2 | 50 | 2000 | 3300 |
| 5 | 0.02 | " | 0.4 | 0.3 | 0.29 | 1.8 | 49 | 7000 | 4200 |
| 6 | 0.01 | 0.5 | 0.02 | 0.06 | 0.017 | —** | 50 | 30 | 4500 |
| 7 | 0.015 | " | 0.03 | " | 0.024 | 1.2 | 48 | 5000 | 4300 |
| 8 | 0.1 | " | 0.2 | 0.4 | 0.098 | 2.0 | 51 | >10000 | 2000 |
| 9 | 0.5 | " | 1 | 0.06 | 0.86 | 1.2 | 31 | 5000 | 1600 |
| 10 | 2 | 0.5 | 4 | 0.4 | 2.0 | 2.0 | 6 | 500 | 1600 |
| 11 | 0.1 | 2 | 0.05 | 0.15 | 0.038 | 1.5 | 52 | 10000 | 4500 |
| 12 | 0.1 | 2 | 0.05 | 0.5 | 0.015 | 2.1 | 42 | 5000 | 4500 |
| 13 | 2 | " | 1 | 0.15 | 0.77 | 1.5 | 30 | 4000 | 2000 |
| 14 | 5 | 10 | 0.5 | " | 0.38 | " | 7 | 200 | " |
| 15 | 10 | 5 | 2 | " | 1.5 | " | 5 | 100 | — |
| 16 | 1.2 | " | 0.24 | 0.3 | 0.15 | 1.8 | 44 | >10000 | 3500 |
| 17 | 5 | " | 1 | 0.06 | 0.90 | 1.2 | 28 | 1000 | 1600 |
| 18 | 0.01 | 2 | 0.005 | " | 0.005 | —** | 40 | 10 | 4000 |

Note
*α: non-linearity coefficient
**No γ-form $Bi_2O_3$ phase

As noted from Table 1, the non-linearity coefficient is small and the life at the continuous AC operating stress is short when the content of $Bi_2O_3$ in the sintered body is too low (No. 1) or the content of $Bi_2O_3$ and $B_2O_3$ is too high (No. 14, No. 15) or the $B_2O_3/Bi_2O_3$ molar ratio is too high (No. 10, No. 15). The specimens containing no $B_2O_3$ (No. 1, No. 2) show large values of non-linearity coefficient but are short in the life at the continuous AC operating stress. Also, when the $B_2O_3/Bi_2O_3$ molar ratio is less than 0.03, no $\gamma$-$Bi_2O_3$ phase is formed and hence the properties of the product are unstable. For obtaining the life at the continuous AC operating stress of over 1,000 hours (over about 100 years in terms of the life under the actual use conditions), the following ranges appear desirable for the same reason as set forth in Example 1: 0.05% by mole$\leqq Bi_2O_3 \leqq$5% by mole, 0.01% by mole$\leqq B_2O_3 \leqq$5% by mole, $0.03 \leqq B_2O_3/Bi_2O_3 \leqq 1$ (molar ratio), and ($\gamma$-$Bi_2O_3$ in the surface layer)/($\gamma$-$Bi_2O_3$ in the center portion)>about 1.2 (molar ratio).

In case the element is to be adopted as an arrester for a UHV system (over 1,000 kV), the element is required to have a rectangular-current impulse withstand capability of 3,000 A or more when the element is of a size on the order of 60 mm in diameter and 20 mm in thickness, and when the safety factor is taken into account, it is desirable that the element has such withstand capability of 4,000 A or more. These factors dictate that the $B_2O_3/Bi_2O_3$ in the surface layers should be 0.3 or less, and the range of $0.03 \leqq B_2O_3/Bi_2O_3 \leqq 0.3$ (molar ratio) is more preferable.

In order to observe the influence of diffusion temperature, the elements were prepared in the same way as said above except that the diffusion temperature along was changed to 750° C. and 1,150° C. It was learned that when the diffusion temperature was 750° C., no satisfactory diffusion was obtained and all of $Bi_2O_3$ in the sintered body changed into the $\gamma$-form, resulting in a small non-linearity coefficient (5-8) and a short life. When the diffusion temperature was 1,150° C., not enough $\gamma$-form $Bi_2O_3$ phase was formed in the sintered body after the diffusion and the life was short.

EXAMPLE 4

A sintered body having the following additive compositions in the surface and inside (central) layers was molded and sintered at 1,200° C. for 2 hours.

| | Surface layer | Inside (central) layer |
|---|---|---|
| $B_2O_3$ | 0.05% by mole | 0.1% by mole |
| $Bi_2O_3$ | 1% by mole | 0.5% by mole |
| $MnCO_3$ | 1% by mole | 1% by mole |
| $Co_2O_3$ | 0.5% by mole | 0.5% by mole |
| $Cr_2O_3$ | 0.1% by mole | 0.1% by mole |
| $Sb_2O_3$ | 2% by mole | 2% by mole |
| $Al(NO_3)_3$ | 0.01% by mole | 0.01% by mole |
| ZnO | Balance | Balance |

Said inside layer had a thickness of 15 mm, and the surface layer with a thickness of 3 mm was formed on both principal surfaces. After sintering, said both surfaces were polished to remove a thickness of 1.5 mm and heat treated at 750° C. for 3 hours, and then electrodes were provided thereto.

The molar ratio of $\gamma$-$Bi_2O_3$ in the surface layer to $\gamma$-$Bi_2O_3$ in the inside layer of the obtained element was approximately 2. The rectangular-current impulse withstand capability of said element was 3,800 A and the life under a AC voltage application at an applied voltage ratio of 85% (85% of the voltage required for flowing a DC current of 1 mA at 20° C.) at 90° C. was over 10,000 hours.

When the surface layers were composed of the same composition as the inside layer, the resulting element showed a rectangular-current impulse withstand capability of 2,700 A and the life (at the continuous AC operating stress) of 2,000 hours.

The distribution of the $\gamma$-$Bi_2O_3$ phase as observed when changing the $Bi_2O_3$ to $B_2O_3$ molar ratio in the sintered body and the life at the continuous AC operating stress determined in the same way as said above are shown in Table 2.

TABLE 2

| Run No. | Inside (central) portion Mixing ratio (% by mole) $B_2O_3$ | $Bi_2O_3$ | $B_2O_3/Bi_2O_3$ (molar ratio) | Surface layer Mixing ratio (% by mole) $B_2O_3$ | $Bi_2O_3$ | $B_2O_3/Bi_2O_3$ (molar ratio) | $\gamma$-$Bi_2O_3$ in the surface layer / $\gamma$-$Bi_2O_3$ in the inside (central) portion | Life at continuous AC operating stress (hours) |
|---|---|---|---|---|---|---|---|---|
| 19 | 0 | 0.02 | — | 0.01 | 0.05 | 0.2 | 2.5 | 40 |
| 20 | 0 | 0.05 | — | 0.02 | 0.1 | " | 2.0 | 100 |
| 21 | 0.01 | " | 0.2 | 0.01 | 0.05 | " | 1.0 | 500 |
| 22 | " | " | " | " | 0.06 | 0.16 | 1.2 | 2000 |
| 23 | " | " | " | 0 | 0.5 | — | 10 | 300 |
| 24 | " | " | " | 0.01 | " | 0.02 | 10 | 10000 |
| 25 | " | 0.5 | 0.02 | " | 1.0 | 0.01 | 2.0 | >10000 |
| 26 | 0.1 | " | 0.2 | 0.1 | 0.5 | 0.2 | 1.0 | 600 |
| 27 | " | " | " | " | 0.6 | 0.16 | 1.2 | 3000 |
| 28 | 0.1 | 0.5 | 0.2 | 0.1 | 1.0 | 1.0 | 2.0 | 10000 |
| 29 | 0.5 | " | 1.0 | 0.5 | " | 0.5 | " | 3000 |
| 30 | 2.0 | 0.5 | 4.0 | 0.5 | 1.0 | 0.5 | 2.0 | 300 |
| 31 | 0.1 | 4.0 | 0.025 | 0.1 | 5.0 | 0.02 | 1.25 | 10000 |
| 32 | 1.0 | " | 0.25 | " | " | " | " | 10000 |
| 33 | 6.0 | " | 1.5 | " | " | " | " | 700 |
| 34 | 0 | " | — | " | " | " | " | 30 |
| 35 | 1.0 | 5.0 | 0.2 | 0.3 | 6.0 | 0.05 | 1.2 | 800 |
| 36 | " | 10.0 | 0.1 | 0.1 | 10.0 | 0.1 | 1.0 | 300 |

It is clear from Table 2 that when both the surface layers and the central portion have the following ranges of compositions, there can be obtained particularly a long life at the continuous AC operating stress: 0.05% by mole$\leqq Bi_2O_3 \leqq$5% by mole, 0.01% by mole$\leqq$B-

$_2O_3 \leqq 5\%$ by mole, $B_2O_3/Bi_2O_3 \leqq 1$ (molar ratio), and $1.2 \leqq$ ($\gamma$-form $Bi_2O_3$ in the surface layer)/($\gamma$-form $Bi_2O_3$ in the central portion) $\leqq 10$ (molar ratio).

As viewed above, the nonlinear resistor element according to this invention is markedly improved in life at continuous AC operating stress as compared with the conventional elements.

EXAMPLE 5

To ZnO, 0.7% by mole of $Bi_2O_3$, 0.5% by mole of $MnCO_3$, 1.0% by mole of $Co_2O_3$, 0.5% by mole of $Cr_2O_3$, 1.0% by mole of $Sb_2O_3$, 1.0% by mole of NiO, 1.5% by mole of $SiO_2$, 0.1% by mole of $B_2O_3$ and 0.005% by mole of $Al(NO_3)_3$ were added (a total being 100% by mole) and mixed in a ball mill for 10 hours. To this powdered mixture was added 10% of a 2% polyvinyl alcohol solution and the mixture was granulated. A disc was molded therefrom and fired in air at 1,160° C. for 5 hours. The principal surfaces of the obtained sintered body were polished to remove a thickness of 0.5 mm each to obtain an element of 60 mm in diameter and 20 mm in thickness. Then a paste composed of 4 g of bismuth oxide, 0.05 g of ethyl cellulose and 0.4 g of butyl carbitol was applied substantially uniformly to said both principal surfaces of the element while leaving uncoated the outer peripheral edge in 3 mm wide, followed by a 2-hour heat treatment at 950° C. Lastly Al was flame sprayed to said both principal surfaces to form electrodes of 56 mm in diameter so that the electrode ends reached said uncoated portion.

The thus obtained element had a non-linearity coefficient (at current application of $3\times10^{-6}$ to $3\times10^{-4}$ A/cm$^2$) of 52 and a flatness (ratio of the voltage at current application of $3\times10^{+3}$ A/cm$^2$ to the voltage at $3\times10^{-4}$ A/cm$^2$) of 1.54.

Figure 9:
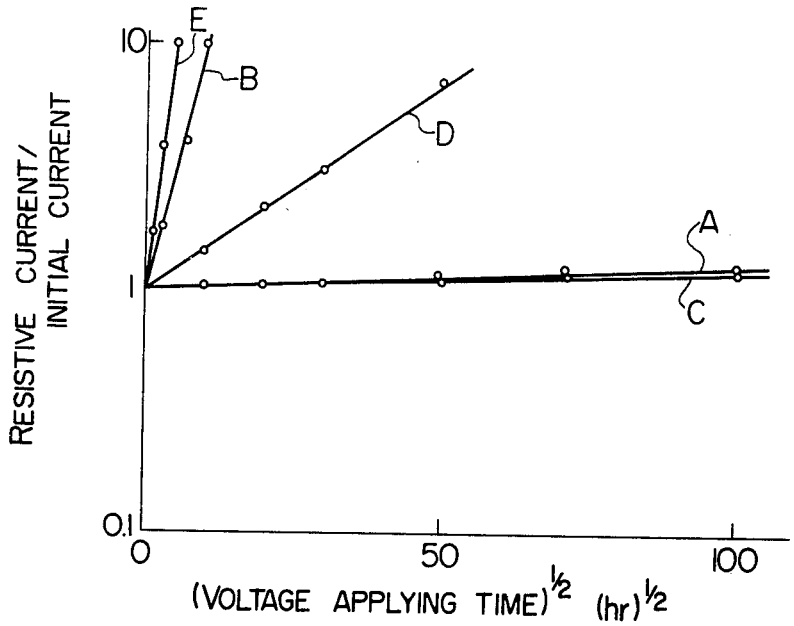
FIGS. 9 to 11 are graphs of characteristic curves showing property comparisons between the nonlinear resistors according to this invention and the conventional ones.

FIG. 9 graphically shows the pattern of change with time of the resistive leakage current in the nonlinear resistor of this invention when an AC current was applied continuously thereto at an applied voltage ratio of 100% at the temperature of 90° C. In the graph of FIG. 9, A represents the element obtained in this Example, B represents an element obtained in the same way as this Example but not yet subjected to diffusion of bismuth oxide, C represents an element which has its both principal surfaces coated with the same amount of paste as used in this Example and having diffused bismuth oxide phase, D represents an element obtained in the same way as this Example but not containing boron oxide as additive, and E represents an element obtained similarly to the element D but not yet subjected to diffusion of bismuth oxide.

As shown in FIG. 9, the element of this invention and the element C are minute in change of resistive current and have a remarkably long life as compared with other elements. When possible acceleration of property degrading rate by temperature is taken into account, the total current application time of 10,000 hours at 90° C. is equivalent to more than 100 years in use at 40° C. under the actual use conditions, which implies excellent availability of the nonlinear resistor of this invention as an arrester for a UHV transmission system (over 1,000 kV).

The rectangular-current impulse withstand capabilities at 2 msec of the respective elements A to E of FIG. 9 are shown in Table 3.

For effective adaptation as an arrester for UHV (over 1,000 kV), the element needs to have a rectangular-current impulse withstand capability of 3,000 A or more when the element size is of the order of 60 mm in diameter and 20 mm in thickness, but when the safety factor is taken into account, it is desirable that said withstand capability of the element is 4,000 A or more. Table 3 shows that the element according to this invention (A) has a satisfactory rectangular-current impulse withstand capability while the element C, although having a favorable life at the continuous AC operating stress and is practically usable, is unsatisfactory in its rectangular-current impulse withstand capability compared with the element A. The rectangular-current impulse withstand capability of element A is 4500–4800 A and dispersion of the withstand capability value is small.

TABLE 3

| Element | Rectangular-current impulse withstand capability (A)* |
|---|---|
| A | 4,500 |
| B | 3,600 |
| C | 2,000** |
| D | 4,200 |
| E | 3,500 |

(Note)
*minimum value
**dispersed in the range of 2000 to 3600 A

Figure 10:
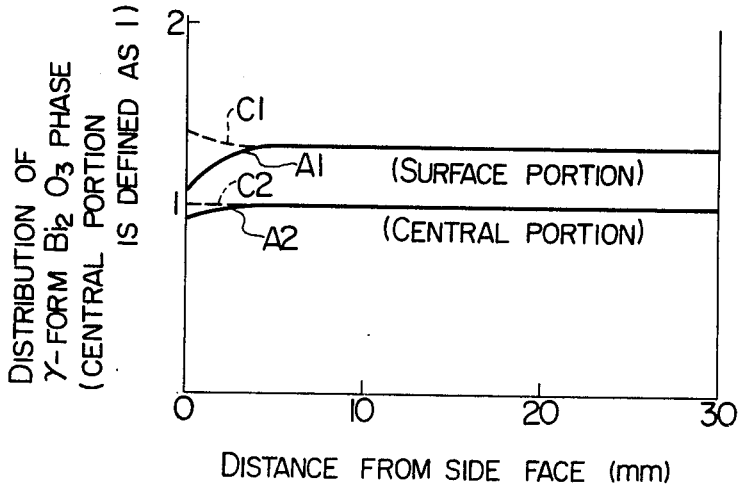
Figure 11:
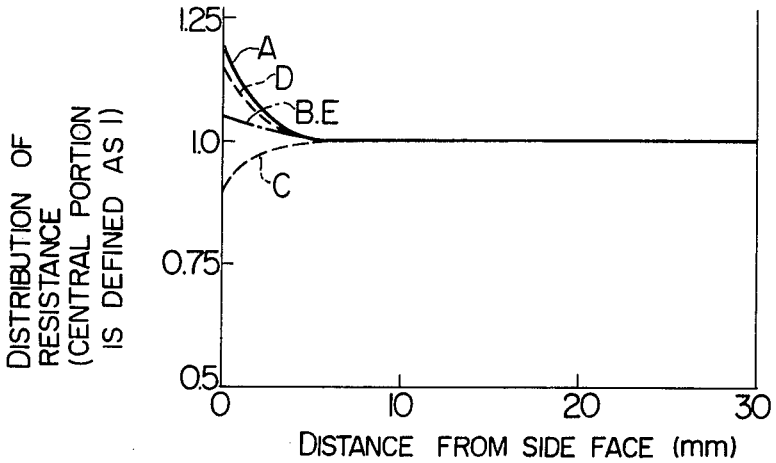

FIGS. 10 and 11 are graphical representations of the distribution of $\gamma$-form bismuth oxide and the distribution of resistance, respectively, in the produced nonlinear resistors. The $\gamma$-form bismuth oxide phase distribution was determined by cutting the element parallel to the electrode surface so as to cut out the pieces of 1 mm thick from the surface and central portion of the element, more finely dividing the respective cut pieces from the outside toward the inside along the radial direction by a width of 1 mm each, powdering the finely cut pieces and measuring the distribution in the radial direction for each of the surface and central portions of the element from the diffraction intensities of the $\gamma$-$Bi_2O_3$ phase according to the X-ray powder diffraction method. In the measurement, the reflective lines with spacing of 2.71–2.72 Å were used and they were standardized by the diffracted line intensity of ZnO. FIG. 10 shows the distribution of $\gamma$-form $Bi_2O_3$ phase when the $\gamma$-form bismuth oxide phase concentration in the central portion is defined as 1. The resistance distribution was determined from the voltage distribution by contacting a 1 mm-diameter probe at the corresponding points on both principal (electrode-forming) surfaces of the specimen (before formation of electrodes) and measuring the distribution of voltage when flowing a current of 2 $\mu$A (current density: $3\times10^{-4}$ A/cm$^2$) while shifting the probe along the radial direction.

As shown in FIG. 10, in the nonlinear resistor according to this invention, the surface portion (A1) of the element is in average higher in the $\gamma$-form bismuth oxide phase concentration than the central portion (A2), but at any portions, the amount of $\gamma$-form bismuth oxide phase decreases at nearer the side face. It will be also shown that, in the surface layer (A1), the $\gamma$-form bismuth oxide phase concentration is lower at the peripheral portion than in the inside, and also the $\gamma$-form bismuth oxide phase content in the side face layers (A2) is less than that in the inside portion. Accordingly, in the element A, the side face layer is high in resistance as noticed from FIG. 11. In the element C, on the other hand, the surface portion (C1) is higher in $\gamma$-form bismuth oxide phase concentration than the central portion (C2). Particularly, the content is high at the portion close to the side face. This is considered due to flow of the bismuth oxide phase from the electrode-forming surfaces to a part of the side face during the diffusion, too. The same reason will account for the small resistance in the side face layers in the element C.

Elements B, D and E contains no γ-form bismuth oxide phase. In these specimens, the resistance in the surface layers is slightly increased as seen in FIG. 11. This is ascribed to the density distribution in the sintered body and the influence of evaporation of $Bi_2O_3$ during the sintering.

EXAMPLE 6

A sintered body obtained in the same manner as described in Example 5 was polished at its both principal surfaces, then coated substantially uniformly with the same paste as used in Example 5 while leaving uncoated the outer peripheral edge portion in 1 mm wide and then heat treated at 950° C. for 2 hours. Lastly A1 was flame-sprayed to said both principal surfaces to form electrodes of 56 mm in diameter.

The non-linearity coefficient of the obtained element was 50 and its flatness was 1.55. It also showed a long life at the continuous AC operating stress, just like the elements A and C represented in FIG. 9, and the resistive current didn't reach twice the initial value even after 10,000-hour voltage application. Further, the rectangular-current impulse withstand capability was on the order of 4,100 A, a value ensuring practical adoptation of the element as an arrester for UHV.

Examination of the γ-form bismuth oxide phase distribution in the element, conducted in the same manner as described in Example 5, revealed that the γ-form bismuth oxide phase concentration in the electrode-forming surfaces is higher than that in the central portion and that, in the portions close to said surfaces, the γ-form bismuth oxide phase concentration in the section of 1 mm wide (the side face layer) from the side face is lower than that in the inside portion. It was also confirmed by the same method as Example 5 that the side face layer is higher in resistance than in the inside portion.

The γ-form bismuth oxide phase distribution in an element prepared without diffusing bismuth oxide in the sintered body but by merely performing a 2-hour heat treatment at 950° C. after sintering was also examined by the X-ray powder diffraction method, which showed that no γ-form bismuth oxide phase was contained in the element. This indicates that the γ-form bismuth oxide phase detected in the elements in Examples 5 and 6 is a result of the contribution of the diffused bismuth oxide phase.

In order to see the influence of diffusion temperature, the bismuth oxide phase was diffused in the same way as this Example by merely changing the diffusion temperature to 750° C. and 1,150° C. The results showed that, at 750° C., no satisfactory diffusion was provided and also the non-linearity coefficient was as small as 5–8, while at 1,150° C. the amount of γ-form bismuth oxide phase is small in the sintered body after diffusion and the life is short.

As apparent from the foregoing description, the nonlinear resistor provided according to this invention is markedly improved in the life (at the continuous AC operating stress) and also high in long-duration current impulse withstand capability in comparison with the conventional elements.

What is claimed is:

1. A nonlinear resistor comprising a sintered body containing zinc oxide as a major component and at least bismuth oxide and boron oxide, the sintered body having upper and lower surface layers forming the upper and lower surfaces of the sintered body, and at least one electrode formed on at least one of the upper and lower surfaces of the sintered body, characterized in that at least one of the upper and lower surface layers of the sintered body contain a higher γ-form bismuth oxide phase concentration than the inner portion of the sintered body and the periphery portions of the at least one of the upper and lower surface layers have a lower γ-form bismuth oxide phase concentration than the inner portions of the at least one of the upper and lower surface layers.

2. A nonlinear resistor comprising a sintered body containing zinc oxide as a major component and at least bismuth oxide and boron oxide, said sintered body having upper and lower surface layers, forming the upper and lower surfaces of the sintered body, and a side face layer, and at least one electrode formed on at least one of the upper and lower surfaces of the sintered body, characterized in that at least one of the upper and lower surface layers of the sintered body contain a higher γ-form bismuth oxide phase concentration than the inner portion of the sintered body and the side face layer including the peirphery portions of the at least one of the upper and lower surface layers has a lower γ-form bismuth oxide phase concentration than the inner portions of the sintered body when compared in parallel to the electrodes.

3. A non-linear resistor according to claim 1 or 2, wherein the ends of electrodes reach the periphery portions of the at least one of the upper and lower surface layers wherein the γ-form bismuth oxide phase concentration is lower than the inner portions of the at least one of the upper and lower surface layers.

4. A non-linear resistor according to claim 1 or 2, wherein the at least one of the upper and lower surface layers contain boron oxide and bismuth oxide in a molar ratio of $B_2O_3/Bi_2O_3 \leqq 0.3$.

5. A nonlinear resistor according to claim 1 or 2, wherein all of the bismuth oxide contained in the sintered body is γ-form bismuth oxide.

6. A nonlinear resistor according to claim 1 or 2, wherein the sintered body is produced by sintering a raw material composition containing zinc oxide as a major component and at least bismuth oxide and boron oxide.

7. A nonlinear resistor according to claim 1 or 2, wherein the sintered body comprises zinc oxide as a major component and at least 0.01 to 5% by mole of boron oxide and 0.05 to 5% by mole of bismuth oxide.

8. A non-linear resistor according to claim 1 or 2, wherein the sintered body is produced by diffusing bismuth oxide from at least one of the upper and lower surfaces of the sintered body except for the periphery portions of the at least one of the upper and lower surface layers.

9. Use of nonlinear resistors of claim 1 or 2 for making an arrester comprising a housing means and at least one of said nonlinear resistors piled in the housing means.

10. Use of nonlinear resistors according to claim 9, wherein the arrester is free from elements for correcting electric field.

11. Use of nonlinear resistors according to claim 10, wherein an element for correcting electric field is a capacitor.

12. A nonlinear resistor according to claim 1 or 2, wherein at least one electrode is formed on the upper surface of the sintered body and at least one electrode is formed on the lower surface of the sintered body.

13. A nonlinear resistor according to claim 3, wherein at least one electrode is formed on the upper surface of the sintered body and at least one electrode is formed on the lower surface of the sintered body.

14. A nonlinear resistor according to claim 8, wherein at least one electrode is formed on the upper surface of the sintered body and at least one electrode is formed on the lower surface of the sintered body.

15. Use of nonlinear resistors according to claim 10, wherein an element for correcting electric field is a metallic shield.

16. A nonlinear resistor according to claim 2, wherein said side face layer has a thickness of 1/200 to 1/10 the width of the sintered body.

17. A nonlinear resistor according to claim 16, wherein the thickness of the side face layer is 1/120 to 1/30 the width of the sintered body.

18. An arrestor comprising a housing means and at least one nonlinear resistor, with at least one of said at least one nonlinear resistors comprising:

a sintered body containing zinc oxide as a major component and at least bismuth oxide and boron oxide, the sintered body having upper and lower surface layers forming the upper and lower surfaces of the sintered body, and at least one electrode formed on at least one of the upper and lower surfaces of the sintered body, characterized in that at least one of the upper and lower surface layers of the sintered body contain a higher γ-form bismuth oxide phase concentration than the inner portion of the sintered body and the periphery portions of the at least one of the upper and lower surface layers have a lower γ-form bismuth oxide phase concentration than the inner portions of the at least one of the upper and lower surface layers.

19. An arrester comprising a housing means and at least one nonlinear resistor, with at least one of said at least one nonlinear resistors comprising:

a sintered body containing zinc oxide as a major component and at least bismuth oxide and boron oxide, said sintered body having upper and lower surface layers, forming the upper and lower surfaces of the sintered body, and a side face layer, and at least one electrode formed on at least one of the upper and lower surfaces of the sintered body, characterized in that at least one of the upper and lower surface layers of the sintered body contain a higher γ-form bismuth oxide phase concentration than the inner portion of the sintered body and the side face layer including the periphery portions of the at least one of the upper and lower surface layers has a lower γ-form bismuth oxide phase concentration than the inner portions of the sintered body when compared in parallel to the electrodes.

20. An arrester according to claim 18 or 19, wherein the housing means is a metal tank.

21. An arrester according to claim 18 or 19, wherein the arrester is free from elements for correcting electric field.

22. An arrester according to claim 21, wherein an element for correcting electric field is a capacitor.

23. An arrester according to claim 18 or 19, wherein the housing means is an insulator.

24. An arrester according to claim 21, wherein an element for correcting electric field is a metallic shield.

25. A nonlinear resistor according to claim 1, 2, 16 or 17 wherein the thickness of said at least one of the upper and lower surface layers is 1/100 to 1/6 the thickness of the sintered body.

26. A nonlinear resistor according to claim 25, wherein the thickness of said at least one of the upper and lower surface layers is 1/40 to 1/10 the thickness of the sintered body.

* * * * *